US007055599B2

(12) United States Patent
Kasevich

(10) Patent No.: US 7,055,599 B2
(45) Date of Patent: Jun. 6, 2006

(54) ELECTROMAGNETIC COAL SEAM GAS RECOVERY SYSTEM

(75) Inventor: Raymond S. Kasevich, Mt. Washington, MA (US)

(73) Assignee: KAI Technologies, Great Barrington, MA (US)

( * ) Notice: Subject to any disclaimer, the term of this patent is extended or adjusted under 35 U.S.C. 154(b) by 46 days.

(21) Appl. No.: 10/450,967

(22) PCT Filed: Dec. 18, 2001

(86) PCT No.: PCT/US01/49083

§ 371 (c)(1),
(2), (4) Date: Dec. 12, 2003

(87) PCT Pub. No.: WO02/50399

PCT Pub. Date: Jun. 27, 2002

(65) Prior Publication Data

US 2004/0074638 A1 Apr. 22, 2004

Related U.S. Application Data

(60) Provisional application No. 60/256,367, filed on Dec. 18, 2001.

(51) Int. Cl.
*E21B 43/16* (2006.01)

(52) U.S. Cl. ..... 166/248; 166/302; 166/60

(58) Field of Classification Search ..... 166/248, 166/302, 60, 304, 369; 405/128.6, 128.4, 405/128.85

See application file for complete search history.

(56) References Cited

U.S. PATENT DOCUMENTS

| | | | | | |
|---|---|---|---|---|---|
| 4,583,589 | A | * | 4/1986 | Kasevich | 166/60 |
| 4,638,863 | A | * | 1/1987 | Wilson | 166/248 |
| 4,817,711 | A | * | 4/1989 | Jeambey | 166/248 |
| 4,912,971 | A | * | 4/1990 | Jeambey | 73/152.54 |
| 5,055,180 | A | * | 10/1991 | Klaila | 208/402 |
| 5,065,819 | A | * | 11/1991 | Kasevich | 166/248 |
| 5,109,927 | A | * | 5/1992 | Supernaw et al. | 166/248 |
| 5,199,488 | A | * | 4/1993 | Kasevich et al. | 166/248 |
| 5,236,039 | A | * | 8/1993 | Edelstein et al. | 166/248 |
| 5,293,936 | A | * | 3/1994 | Bridges | 166/248 |
| 5,370,477 | A | * | 12/1994 | Bunin et al. | 405/128.65 |

FOREIGN PATENT DOCUMENTS

WO WO 200057021 A1 * 9/2000

* cited by examiner

*Primary Examiner*—Jennifer H. Gay
*Assistant Examiner*—Daniel P Stephenson
(74) *Attorney, Agent, or Firm*—Dorsey & Whitney, LLP

(57) ABSTRACT

A system for recovering gas trapped within the earth includes a casing (24) sized and configured to be positioned within a borehole in the earth, the casing (24) formed of a material that is transmissive to electromagnetic energy and gas within the earth; an antenna (40) sized and configured to be positioned within the casing (24). The antenna (40) has a distal end and a proximal end and including a radiating element at the distal end of the antenna (40) which, in operation, transmits electromagnetic energy toward a desired area of the earth, and an interior channel for allowing gas to be conveyed from the distal end to the proximal end of the antenna (40).

22 Claims, 4 Drawing Sheets

ELECTROMAGNETIC COAL SEAM GAS RECOVERY SYSTEM

This application claims the benefit of Provisional Application No. 60/256,367, filed Dec. 18, 2001.

BACKGROUND

The invention relates to the recovery of gas from subterranean formations in the earth.

Extensive and high volumes of hydrocarbon gases (e.g., methane) trapped within coal seams have been discovered in various parts of the United States. For example, large amounts of trapped methane gas have been discovered in eastern Wyoming (see, for example, "Powder River Basin Coalbed Methane Play Heats Up," E&P Perspectives, Vol. X, R57, Oct. 22, 1998 (attached herewith). Naturally occurring degradation processes, such as the biodegradation of microorganisms in the coal is believed to cause the generation of the methane gas trapped within the coal seams.

Methods of economic and environmentally sound gas recovery are underway. A major problem encountered is the large amount of aquifers (water) that impedes the ability to recover the gas from bore holes drilled in to the coal seam. Specifically, the in-ground water serves as a barrier to the effective removal of the gas from the bore hole. The water must be removed by a pump or redirected to allow more efficient removal of the gas. Systems of co-generation of power for pumps are being considered for the prime supply of electrical energy for the pumps. That is, the electrical power for operating gas turbines used to drive the pumps could be generated using a portion of the gas removed from the borehole.

SUMMARY

In a general aspect of the invention, a system for recovering gas trapped within the earth, the system includes a casing sized and configured to be positioned within a borehole in the earth, the casing formed of a material that is transmissive to electromagnetic energy and gas within the earth, and an antenna sized and configured to be positioned within the casing. The antenna includes a radiating element at a distal end of the antenna which, in operation, transmits electromagnetic energy toward a desired area of the earth, and an interior channel for allowing gas to be conveyed from the distal end to a proximal end of the antenna.

In another aspect of the invention, a method for recovering gas trapped within the earth includes the following steps. A casing is positioned within a borehole in the earth, the casing formed of a material that is transmissive to electromagnetic energy and gas within the earth. An antenna is positioned within the casing, the antenna having a distal end and a proximal end. The antenna includes a radiating element at the distal end of the antenna which, in operation, transmits electromagnetic energy toward a desired area of the earth; and an interior channel for allowing gas to be conveyed from the distal end to the proximal end of the antenna. The method further includes applying electromagnetic energy to the antenna to radiate the earth surrounding the casing; drawing gas within the earth into the interior channel of the antenna at the distal end of the antenna; and conveying the gas within the interior channel to the proximal end of the antenna.

Embodiments of these aspects of the invention may include one or more of the following features.

A product return pipe has a first end connected to the proximal end of the antenna and a removable cap attached to a second end of the product return pipe. A bellows is connected to the proximal end of the antenna. A thermocouple assembly is connected to the proximal end of the antenna.

The antenna is configured to operate in a frequency range between 300 KHz and 300 GHz. More particularly, the frequency range is between 1 MHz and 100 MHz (e.g., about 27 MHz). The antenna is configured to operate at a power level in a range between 3 Kwatts and 20 Kwatts (e.g., about 10 Kwatts).

Among other advantages, the system and method (1) reduce the negative impact of water on the in situ recovery of coal gas, such as methane from underground beds or seams of coal; and (2) provide additional or enhanced stimulation of gas production from the coal deposits.

The basic energy source proposed for reducing the water barrier effect and stimulating production in-situ is electromagnetics. Electromagnetic energy at frequencies as low as 60 Hz and extending into the microwave frequencies supplied by earth electrodes in the form of antennas and/or waveguides may be employed in the proposed processes. The basic idea is to introduce current into the subterranean formation to vaporize or boil the water in a specified region of the coal seam. The currents are derived from the electromagnetic field energy absorbed by the coal material and water.

Specific in-ground applicator structures such as rod electrodes, antennas or waveguides and transmission lines provide the induced currents in the coal seam to vaporize a given amount of water. For example, antennas in a vertical or horizontal bore hole drilled in a coal seam radiate electromagnetic energy away from the antenna into the coal creating a dry region around the bore hole/antenna structure. A pump can be used in conjunction with the antenna for water removal or the bore hole containing the antenna may be pressurized to keep the water away from the antenna/bore hole.

A special gas filtering system can be employed around the antenna (within or outside the bore hole) to permit gas recovery up to the antenna bore hole without water. This special filter would block liquid water and allow only gas to pass through it.

The dry region around the antenna borehole created by dielectric heating of the coal/water matrix is maintained by the power supplied by the antenna (e.g., 3 to 20 kilowatts on average). This dry region, maintained by either resistive (low frequency) currents or dielectric (high frequency) currents in the coal seam, allows the gas to be transferred from regions outside the casing to within the antenna case, bore hole, or adjacent recovery wells equipment with special filters and flow lines for ease of gas recovery without water.

The dry sheath region or zone is maintained at approximately 100° C. to ensure that there is no liquid water.

Thermal energy is not a requirement for the gas deposits in place. As a result of the dielectric sheath created by electromagnetic currents, the radiation fields of the antenna now extend further into the coal seam away from the antenna bore hole thereby creating an enhanced zone or region of heating and results in an enlargement of the dry zone and less impedance of gas flow to the recovery well by water.

Another benefit of electromagnetic heating is the enlargement of fracture zones in the coal seams by steam pressure and thermal gradients. The result is enhanced flow of methane gas to recovery wells.

Still another benefit of electromagnetic heating is the increased activity of microorganisms from the thermal energy deposit, especially at radio frequencies.

The details of one or more embodiments of the invention are set forth in the accompanying drawings and description below. Other features, objects, and advantages of the invention will be apparent from the description and drawings, and from the claims.

DESCRIPTION OF THE DRAWINGS

Like reference symbols in the various drawings indicate like elements.

DETAILED DESCRIPTION

Figure 1:
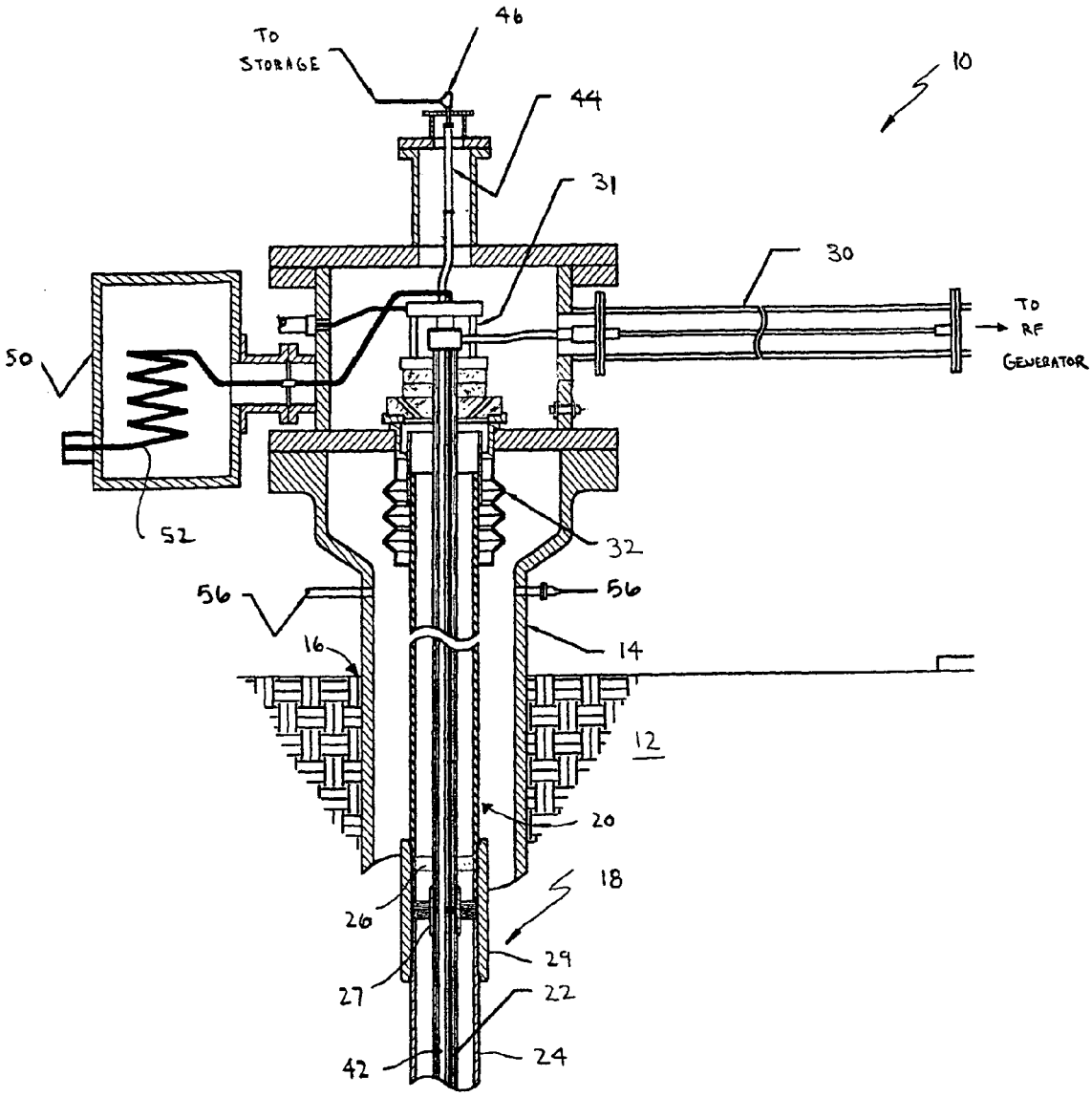
FIG. 1 illustrates the upper portion of an RF gas recovery system in accordance with the invention.
Figure 2:
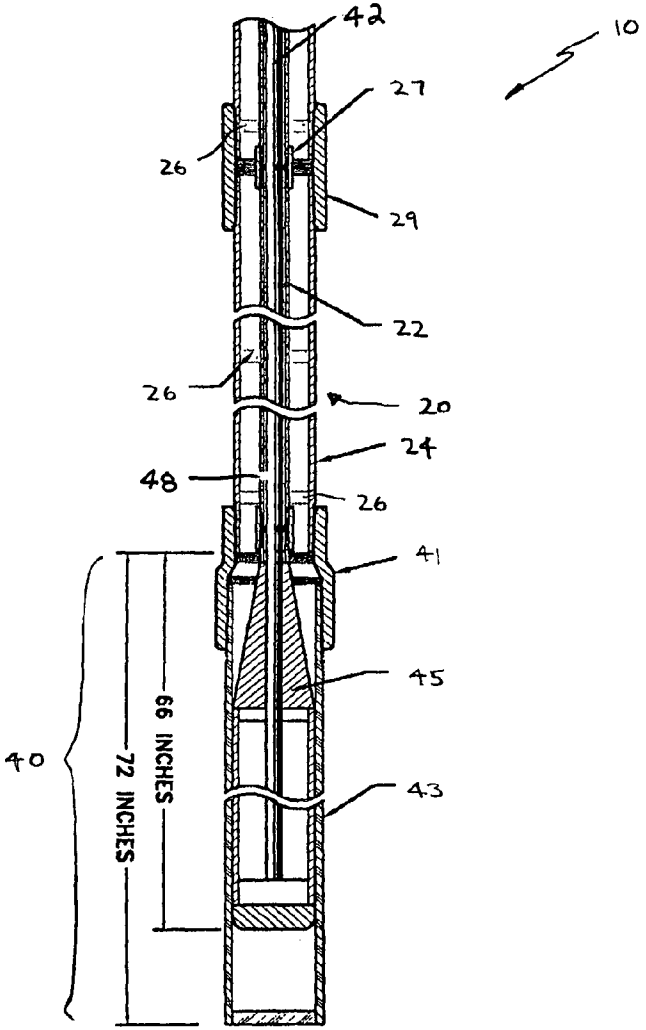
FIG. 2 illustrates the lower portion of the RF gas recovery system of FIG. 1.

Referring to FIGS. 1 and 2, the upper portion of an RF gas recovery system 10 is shown for radiating electromagnetic energy into a coal seam deposited with the ground 12 and extracting gas released by the heating generated by the electromagnetic energy. In particular, gas recovery system 10 includes an outer casing 14 disposed within a borehole 16 drilled deep within the ground. The outer casing 14 houses a coaxial RF applicator 18 that includes a coaxial transmission line 20 extending from the upper end of the antenna at the surface of the earth to a distal end of the antenna. The coaxial transmission line 20 includes a center conductor 22 positioned coaxially within an outer conductor 24. In this embodiment, center conductor 22 and outer conductor 24 have diameters of about 1 inch and 2.9 inches, respectively, and have lengths greater than 30 feet. In general, the length of the RF applicator 18 and the outer casing 14 can be between 8 and 200 feet. Insulative spacers (e.g., Teflon) 26 are spaced along the length of the center conducter 22 to maintain its coaxial position relative to the outer conductor 24. Furthermore, due to the relative long length of RF applicator 18, support collars 27 are spaced periodically along the length of outer conductor 24. The upper end of the coaxial transmission line 20 is connected to an RF generator (not shown) via an RF coax line 30. The upper ends of center conductor 22 and outer conductor 24 of coaxial transmission line 20 include expansion joints in the form of bellows 31 and 32, respectively.

As shown in FIG. 2, in this embodiment, the distal end of the RF applicator includes a dipole antenna 40 extending between 5–6 feet from the end of coaxial transmission line 20. Dipole antenna 40 has a diameter larger than coaxial transmission line 20. A collar 41 is attached at the transition between dipole antenna 40 and coaxial transmission line 20 to provide mechanical support and to ensure a gas-tight seal between outer conductor 24 of transmission line 20 and outer conductor 43 of the dipole antenna. Dipole antenna 40 includes a tapered section 45 which serves as an impedance transformer between the coaxial transmission line and antenna.

In operation, dipole antenna 40 receives RF energy from the RF generator via coaxial transmission line 20 and radiates the coal seam deposit in the surrounding earth. As will be described in greater detail below, the radiated RF energy heats the coal and, in particular, vaporizes or boils the water in a specified region of the coal seam. By removing the water from the coal seam, methane and other gases trapped within the coal seam are released and more easily removed.

Center conductor 22 of transmission line 20 is dual-purposed. The center conductor not only serves as a part of the structure for heating the water in the coal seam, it also provides an inner passage 42 for conveying the gas to the surface of the earth for processing. The gas enters inner passage 42 through intake 48. To remove the gas, a product return pipe 44 having a removable plug 46 extends from the end of center conductor 22 at bellows 32.

RF gas recovery system 10 also includes a thermocouple assembly 50 having a thermocouple coil 52 connected to bellows 32. Thermocouple coils serve as a filter to "choke" or prevent the flow of low frequency currents to flow. Outer casing 14 also includes input pipes 56 through which nitrogen gas is introduced within the casing. The nitrogen gas is much less flammable than oxygen and, therefore, provides a much safer environment for introducing high current levels from RF applicator 18.

The operation of this particular embodiment will now be described. In general, RF applicator 18 is placed within borehole 16 at a depth in a range between eight and 200 feet (e.g., 100 feet) at a location approximately central to a coalbed. RF energy at a power between 3 and 20 KW (here, 10 KW), at a frequency of 27.12 megahertz (MHz) is provided to dipole antenna 40 from the RF generator. When the temperature at the applicator well 20 reaches about 100 degrees C., the radiation power can be cycled down to a lower power level sufficient for maintaining the temperature until the temperature of the borehole 16 cools to a predetermined threshold (e.g., 90 degrees C.) and then the power is cyled back to 10 KW. The cycling of radiation power may be referred to generally as modulating the power, or modulating the radation energy. Such modulation may also include cessation of the process.

It is also appreciated that the applicator well target temperatures implemented in the process may be slected to accommodate the temperature tolerance of the components of RF oil recovery system 10 (e.g., a 150 degree C. tolerance of the coaxial transmission line 20). It is also appreciated that the frequency of the radiated energy from the RF generator can be selected according to FCC regulations, and according to principles well known in the art, including the dielectric heating characteristics of particular media. The energy may include radio frequency energy and microwave energy. In this context, radio frequency energy has a frequency in the range between 300 kilohertz (KHz) and 300 MHz, and microwave energy has a frequency in a range between 300 MHz and 300 GHz.

The RF energy is transmitted from the RF generator to dipole antenna 40 via coaxial transmission line 20. Dipole antenna 40 induces currents within the coal seam causing resistive and/or dielectric heating of the surrounding region of the coal seam. The heating vaporizes or boils the water in the coal seam creating a dry region. The dry region within the coal seam is maintained by resistive hearing (low frequency) currents or dielectric (high frequency) currents and allows the trapped methane gas to be released. The released methane gas flows within outer casing 14 of oil recovery system 10 and to inner passage 42 of center conductor 22 via intake 48 where the methane gas is conveyed to the surface of the earth for processing. In particular applications, a gas filtering system can be positioned around RF applicator 14 (within or outside the bore hole) to permit gas recovery through inner passage 42 without water. The gas filtering system blocks liquid water and allows only the gas to pass through it.

Other embodiments are within the scope of the claims. For example, although RF applicator 14 includes dipole antenna 40, other antenna configurations are equally applicable for use with the RF applicator. For example, referring to FIG. 3, RF applicator 14 can include an antenna 70 which is in the form of an extension of coaxial transmission line 20.

Figure 3:
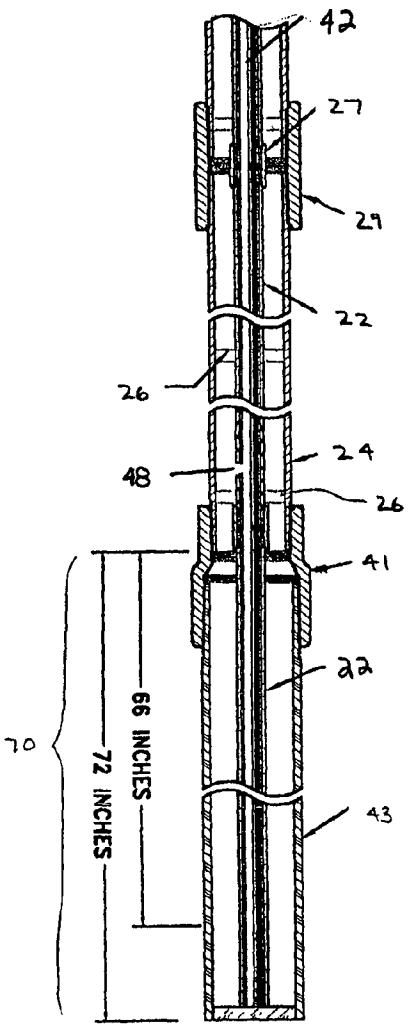
FIG. 3 illustrates an alternative embodiment of a lower portion of the RF gas recovery system of FIG. 1.

The applicators described in conjunction with FIGS. 2 and 3 are designed to provide a predetermined impedance characteristic, for example, to provide a high level of coupling into the coal seam. However, in other embodiments, changing the impedance characteristics of the RF applicator may be desirable. For example, dielectric characteristic of the subterranean formation may differ or change as the water is converted to steam. In such embodiments, the applicator may include a tuning mechanism.

Figure 4:
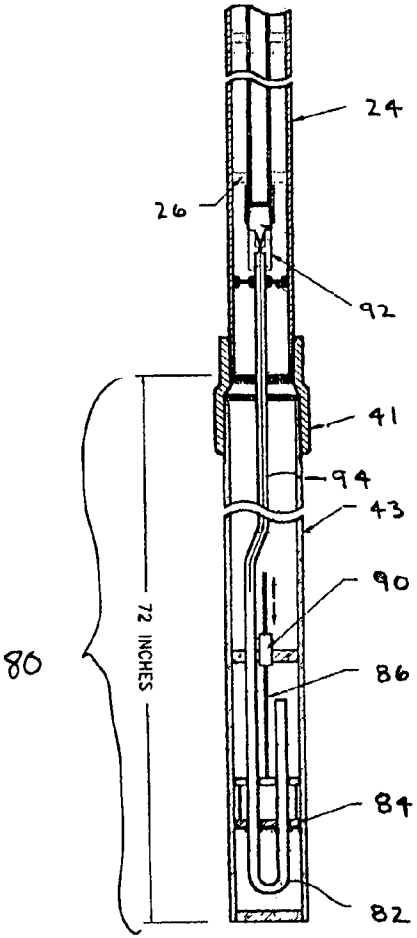
FIG. 4 illustrates another alternative embodiment of the lower portion of the RF gas recovery system of FIG. 1.

Referring to FIG. 4, for example, a shorting link antenna 80 is connected to the distal end of coaxial transmission line 20. In essence, shorting link antenna 80 is a dipole antenna having a looped end 82 and shorting link 84 positioned across the end. An insulated push rod 86 is connected to shorting link 84 such that, in operation, it can be used to move the shorting link and adjust the electrical length of the antenna. A remotely controlled, non-conducting hydraulic actuator 90 is provided to move push rod 86. In the embodiment shown, a center conductor transition 92 is provided between coaxial transmission line 20 and a center conductor 94 of antenna 80. It is important to note that because antenna 80 has a looped end, center conductor 94 has a section offset from the axis of coaxial transmission line 20.

In addition, collinear array antennas, such as those described in U.S. Pat. Nos. 4,583,589, 5,065,819, and 6,097,985, all of which are incorporated herein by reference, are also well-suited for use in RF applicator 14. In addition, the "RF choke" structures described in these references may be desirable for use to prevent the flow of certain frequencies.

The applicators described above in conjunction with FIGS. 2–4 are often referred to as electric antennas. Such antennas are well suited for applications requiring a strong near electric field. In other applications, magnetically coupled antennas may be more suitable. Because the amplitude of the near field is relatively less than that of an electrically coupled antenna, the risk of electric arcing is reduced, thereby increasing safety.

Figure 5:
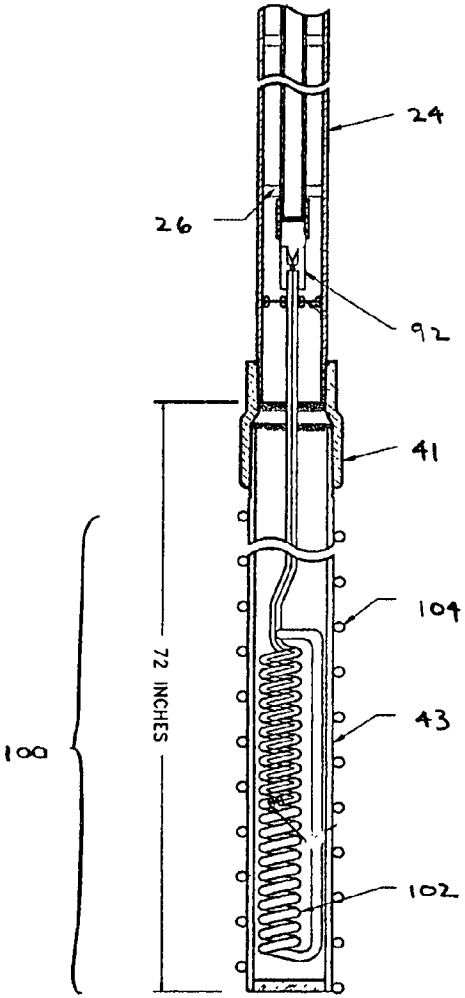
FIG. 5 illustrates still another alternative embodiment of the lower portion of the RF gas recovery system of FIG. 1.
Figure 6:
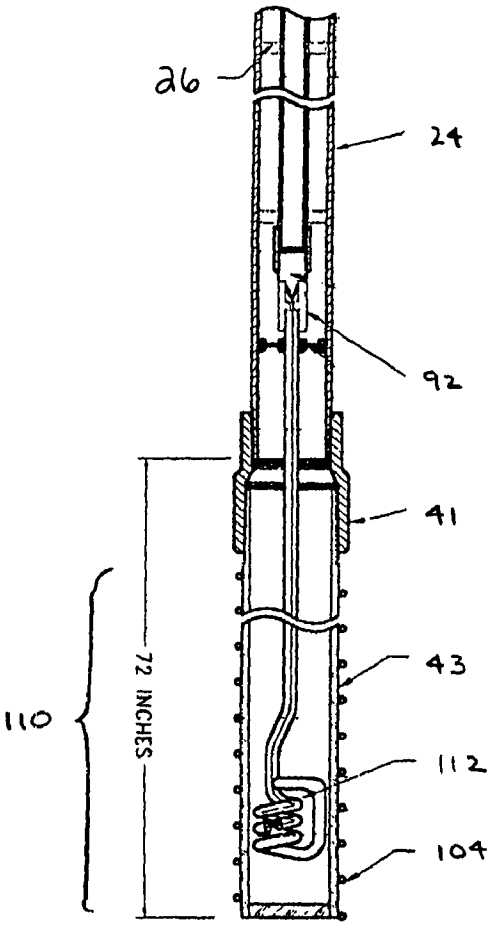
FIG. 6 illustrates still another alternative embodiment of the lower portion of the RF gas recovery system of FIG. 1.

For example, referring to FIGS. 5 and 6, in still other embodiments, helical antennas 100 and 110 include multi-turn links surrounded by an other helix. Specifically, FIGS. 5 and 6 show a twenty-turn link 102 and three-turn link 112, respectively. Multi-turn links are multi-turn loops surrounded by an outer helix 104 which, in turn, surrounds outer conductor 43 and is floating (i.e., has no ground plane). Outer helix 104 is excited in the To mode by the multi-turn links. Excitation in this manner is similar to exciting a rectangular waveguide in the $TE_{10}$ mode with an electric monopole positioned along the centerline of a broad wall of the waveguide. Further details of antennas having this combination of elements can be found in U.S. Pat. No. 6,097,985.

Figure 7:
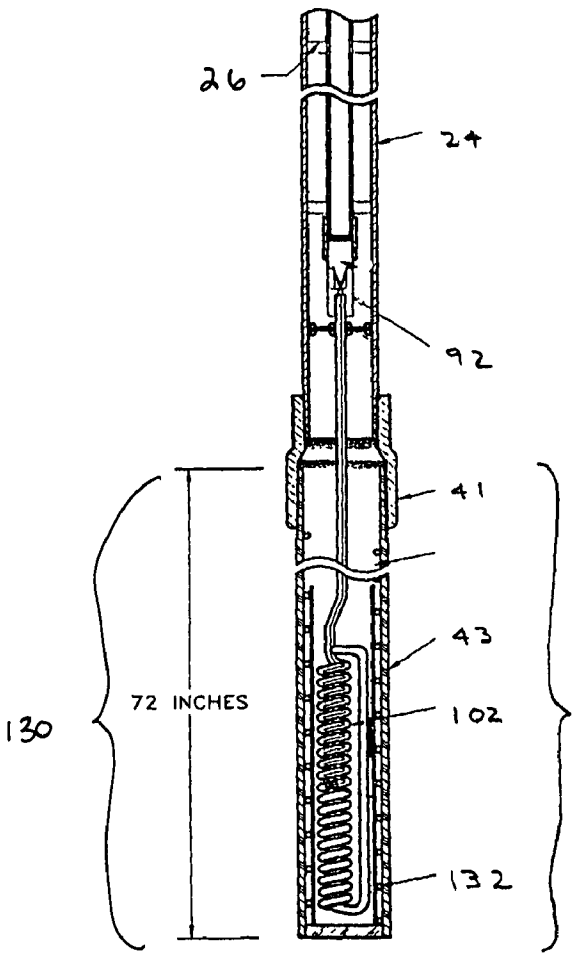
FIG. 7 illustrates still another alternative embodiment of the lower portion of the RF gas recovery system of FIG. 1.

Referring to FIG. 7, a helical antenna 130, similar to that of the helical antenna 100 (shown in FIG. 5) includes a floating outer helix 132, which unlike outer helix 104 of antenna 100 is positioned concentrically within outer conductor 43.

Whether electrically coupled or magnetically coupled antennas, the applicators are designed to maximize the impedance match between the applicator and surrounding media.

Still other embodiments are within the scope of the claims.

What is claimed is:

1. A system for recovering gas trapped within the earth, the system comprising:

a casing sized and configured to be positioned within a borehole in the earth, the casing formed of a material that is transmissive to electromagnetic energy and gas within the earth;

a gas filtering system positioned around the casing to permit gas to pass through to the inside of the casing while blocking liquid from passing through to the inside of the casing;

an antenna sized and configured to be positioned within the casing, the antenna having a distal end and a proximal end and including:

a radiating element at the distal end of the antenna which, in operation, transmits electromagnetic energy toward a desired area of the earth; and an interior channel for allowing gas to be conveyed from the distal end to the proximal end of the antenna.

2. The system of claim 1, further comprising a product return pipe having a first end connected to the proximal end of the antenna and a removable cap attached to a second end of the product return pipe.

3. The system of claim 1, further comprising a bellows connected to the proximal end of the antenna.

4. The system of claim 1 further comprising a thermocouple assembly connected to the proximal end of the antenna.

5. The system of claim 1 wherein the antenna is configured to operate in a frequency range between 300 KHz and 300 GHz.

6. The system of claim 5 wherein the antenna is configured to operate in a frequency range between 1 MHz and 100 MHz.

7. The system of claim 6 wherein the antenna is configured to operate at a frequency of about 27 MHz.

8. The system of claim 6 wherein the antenna is configured to operate at a power level in a range between 3 Kwatts and 20 Kwatts.

9. The system of claim 8 wherein the antenna is configured to operate at a power level of about 10 Kwatts.

10. A method for recovering gas trapped within the earth, the method comprising:

positioning a casing within a borehole in the earth, the casing formed of a material that is transmissive to electromagnetic energy and gas within the earth;

positioning a gas filtering system around the casing to permit gas to pass through to the inside of the casing while blocking liquid from passing through to the inside of the casing;

positioning an antenna within the casing, the antenna having a distal end and a proximal end, the antenna including:

a radiating element at the distal end of the antenna which, in operation, transmits electromagnetic energy toward a desired area of thy earth; and an interior channel for allowing gas to be conveyed from the distal end to the proximal end of the antenna;

applying electromagnetic energy to the antenna to radiate the earth surrounding the is casing;

drawing the gas within the earth into the interior channel of the antenna at the distal end of the antenna; and conveying the gas within the interior channel to the proximal end of the antenna.

11. The method of claim 10 further comprising attaching a first end of a product return pipe to the proximal end of the antenna and attaching a removable cap to a second end of the product return pipe.

12. The method of claim 10 further comprising attaching a bellows to the proximal end of the antenna.

13. The method of claim 10 further comprising attaching a thermocouple assembly connected to the proximal end of the antenna.

14. The method of claim 10 wherein the electromagnetic energy is in a frequency range between 300 KHz and 300 GHz.

15. The method of claim 14 wherein the electromagnetic energy is in a frequency range between 1 MHz and 100 MHz.

16. The method of claim 15 wherein the electromagnetic energy has a frequency of about 27 MHz.

17. The method of claim 15 wherein the electromagnetic energy is at a power level in a range between 3 Kwatts and 20 Kwatts.

18. The method of claim 17 wherein the electromagnetic energy is at a power level of about 10 Kwatts.

19. A system for recovering gas trapped within the earth, the system comprising:

a casing sized and configured to be positioned within a borehole in the earth, the casing formed of a material that is transmissive to electromagnetic energy and gas within the earth;

an antenna sized and configured to be positioned within the casing, the antenna having a distal end and a proximal end and including:

a radiating element at the distal end of the antenna which, in operation, transmits electromagnetic energy toward a desired area of the earth; and an interior channel for allowing gas to be conveyed from the distal end to the proximal end of the antenna; and a bellows connected to the proximal end of the antenna.

20. A system for recovering gas trapped within the earth, the system comprising:

a casing sized and configured to be positioned within a borehole in the earth, the casing formed of a material that is transmissive to electromagnetic energy and gas within the earth;

an antenna sized and configured to be positioned within the casing, the antenna having a distal end and a proximal end and including:

a radiating element at the distal end of the antenna which, in operation, transmits electromagnetic energy toward a desired area of the earth; and an interior channel for allowing gas to be conveyed from the distal end to the proximal end of the antenna; and a thermocouple assembly connected to the proximal end of the antenna.

21. A method for recovering gas trapped within the earth, the method comprising:

positioning a casing within a borehole in the earth, the casing formed of a material that is transmissive to electromagnetic energy and gas within the earth;

positioning an antenna within the casing, the antenna having a distal end and a proximal end, the antenna including:

a radiating element at the distal end of the antenna which, in operation, transmits electromagnetic energy toward a desired area of thy earth; and an interior channel for allowing gas to be conveyed from the distal end to the proximal end of the antenna;

attaching a bellows to the proximal end of the antenna;

applying electromagnetic energy to the antenna to radiate the earth surrounding the is casing;

drawing the gas within the earth into the interior channel of the antenna at the distal end of the antenna; and conveying the gas within the interior channel to the proximal end of the antenna.

22. A method for recovering gas trapped within the earth, the method comprising:

positioning a casing within a borehole in the earth, the casing formed of a material that is transmissive to electromagnetic energy and gas within the earth;

positioning an antenna within the casing, the antenna having a distal end and a proximal end, the antenna including:

a radiating element at the distal end of the antenna which, in operation, transmits electromagnetic energy toward a desired area of thy earth; and an interior channel for allowing gas to be conveyed from the distal end to the proximal end of the antenna;

attaching a thermocouple assembly connected to the proximal end of the antenna;

applying electromagnetic energy to the antenna to radiate the earth surrounding the is casing;

drawing the gas within the earth into the interior channel of the antenna at the distal end of the antenna; and conveying the gas within the interior channel to the proximal end of the antenna.

* * * * *

UNITED STATES PATENT AND TRADEMARK OFFICE

CERTIFICATE OF CORRECTION

PATENT NO. : 7,055,599 B2
APPLICATION NO. : 10/450967
DATED : June 6, 2006
INVENTOR(S) : Raymond S. Kasevich It is certified that error appears in the above-identified patent and that said Letters Patent is hereby corrected as shown below:

In Column 6, line 67, “thy” should read -- the --

In Column 8, line 20, “thy” should read -- the --

In Column 8, line 39, “thy” should read -- the --

Signed and Sealed this

Tenth Day of July, 2007

JON W. DUDAS
*Director of the United States Patent and Trademark Office*